US006780284B2

(12) United States Patent
Almi et al.

(10) Patent No.: US 6,780,284 B2
(45) Date of Patent: Aug. 24, 2004

(54) METHOD AND APPARATUS FOR CONTROLLING MOISTURE PROFILE OF MOVING PAPER WEB

(75) Inventors: Jari Almi, Tampere (FI); Raimo Korhonen, Tampere (FI); Matti Kukkurainen, Tampere (FI); Markku Mäntylä , Kangasala (FI)

(73) Assignee: Metso Automation Oy, Helsinki (FI)

( * ) Notice: Subject to any disclaimer, the term of this patent is extended or adjusted under 35 U.S.C. 154(b) by 0 days.

(21) Appl. No.: 10/464,696

(22) Filed: Jun. 18, 2003

(65) Prior Publication Data

US 2003/0222219 A1 Dec. 4, 2003

Related U.S. Application Data

(63) Continuation of application No. PCT/FI01/01147, filed on Dec. 21, 2001.

(30) Foreign Application Priority Data

Dec. 22, 2000 (FI) ..... 20002838

(51) Int. Cl.[7] ..... G01N 21/86; G01N 21/35; D21F 7/00

(52) U.S. Cl. ..... 162/198; 162/263; 162/DIG. 6; 700/129; 250/341.2

(58) Field of Search ..... 162/198, 263, 162/DIG. 6; 700/122, 129; 702/30; 250/341.2, 341.7, 227.11; 356/429–431, 434–435, 73

(56) References Cited

U.S. PATENT DOCUMENTS

| | | | | |
|---|---|---|---|---|
| 3,806,730 A | * | 4/1974 | Tirkkonen et al. | 250/341.7 |
| 4,801,809 A | | 1/1989 | Burk et al. | |
| 5,019,710 A | | 5/1991 | Wennerberg et al. | |
| 5,172,005 A | | 12/1992 | Cochran et al. | |
| 5,343,296 A | * | 8/1994 | Hellstrom | 356/431 |
| 5,745,365 A | * | 4/1998 | Parker | 700/122 |
| 6,188,077 B1 | * | 2/2001 | Lind | 250/559.01 |
| 6,423,184 B2 | | 7/2002 | Vähätalo et al. | |
| 6,526,369 B1 | * | 2/2003 | Meinecke et al. | 702/170 |
| 2002/0007927 A1 | * | 1/2002 | Vahatalo et al. | 162/198 |
| 2003/0222219 A1 | * | 12/2003 | Almi et al. | 250/341.2 |

FOREIGN PATENT DOCUMENTS

| | | | | |
|---|---|---|---|---|
| CA | 1196512 A | * | 11/1985 | G01N/21/35 |
| DE | 33 36 659 A1 | | 4/1984 | |
| DE | 1980323 | | 1/1999 | |
| DE | 29923284 | | 8/2000 | |
| FI | 45797 | | 5/1972 | |
| FI | 73319 | | 5/1987 | |
| FI | 883318 | | 1/1989 | |
| FI | 933665 | | 8/1993 | |
| FI | 973693 | | 3/1999 | |
| FI | 104988 B | | 5/2000 | |
| FI | 991346 | | 12/2000 | |
| FI | 991348 | | 12/2000 | |
| GB | 1352 043 | | 5/1974 | |

(List continued on next page.)

OTHER PUBLICATIONS

Michael Odell; Optimize or compromise? The art of former section tuning; 51[st] Appita Annual General Conference 1997; pp. 309–316.

"Kosteusprofilin mittaus paperikoneen . . . " Paper and Timber, pp. 377–378, vol. 82, No. 6, 2000.

*Primary Examiner*—José A. Fortuna
(74) *Attorney, Agent, or Firm*—Alston & Bird LLP

(57) ABSTRACT

A method and an apparatus for controlling a moisture profile of a paper web, in which the moisture profile of the paper web prior to drying is measured. The measurement is carried out with a measuring device, which measures a cross-direction profile of the web substantially simultaneously. On the basis of the measurement, the moisture profile of the paper web is controlled prior to drying the paper web.

21 Claims, 3 Drawing Sheets

FOREIGN PATENT DOCUMENTS

| | | | | | |
|---|---|---|---|---|---|
| WO | WO 92/15010 | | 9/1992 | | |
| WO | WO 99/14579 | | 3/1999 | | |
| WO | WO 00/34574 | | 6/2000 | | |
| WO | WO 00/77497 | A1 | 12/2000 | | |
| WO | WO 00/77498 | A1 | 12/2000 | | |
| WO | WO 200252251 | A1 * | 7/2002 | ..... | D21F/7/00 |

* cited by examiner

METHOD AND APPARATUS FOR CONTROLLING MOISTURE PROFILE OF MOVING PAPER WEB

CROSS-REFERENCE TO RELATED APPLICATIONS

This application is a continuation of International Patent Application PCT/FI01/01147 filed Dec. 21, 2001, which designated the United States and was published under PCT Article 21(2) in English, and which is hereby incorporated herein in its entirety by reference.

BACKGROUND OF THE INVENTION

1) Field of the Invention

The invention relates to a method for controlling a moisture profile of a moving paper web during manufacture.

The invention further relates to an apparatus for controlling the moisture profile of the paper web on a paper machine that comprises at least a headbox, a former, a press unit, a dryer unit and a reel.

2) Description of Related Art

As velocities increase, the quality of paper and runability both on the paper machine and in the further processing become more and more important variables. At the same time the number of online processes grow in paper machine concepts, both in new machines and in renovations of old paper machines. For instance, in online after-treatment, particularly in online multi-nip calendering of demanding grades, extremely high requirements are set for cross machine direction (CD) and machine direction (MD) profiles of the paper. A moisture profile is one of these profiles. A poor moisture profile is most typically the major cause of variation in the physical properties as well as in the tension profile.

Currently, the moisture profile of a paper web is typically measured after the dryer section, and the moisture profile is adjusted, e.g., by a steam box of the press section or later at the end of the dryer section, or after the dryer section. The article "Optimize or compromise? The art of former section tuning", Odell M. 51$^{st}$ Appita Annual General Conference 1997 Proceedings, Volume 1, discloses one solution of this kind. However, this solution is not sufficiently able to eliminate defects in the properties of the finished paper resulting from the combined effect of draw differences and moisture profile defects on the paper machine. The combined effect of the draws in the dryer section and the moisture profile defects, as well as drying shrinkage, pose the greatest problem. The combined effect is due to amounts of various tensile components stored in the paper, which produce defects in the stretch at break profile, tension profile and tensile strength profile of the web, such that the greater the draw, the greater the defects in the finished paper.

The article "Kosteusprofiilin mittaus paperikoneen märässä päässä (Moisture profile measurement at the wet end of the paper machine)", Riikka Gerlander, Paperi ja Puu—Paper and Timber, vol. 82, issue June 2000, sets forth moisture profile measurement of a paper web immediately after the press section. A measuring head traversing the paper web in the cross machine direction is employed in the measurement. The publication also refers to a possibility of controlling the operation of the steam box by means of the data collected on the moisture profile. However, this solution is not sufficiently able to eliminate defects in the properties of the finished paper resulting from the combined effect of draw differences and moisture profile defects on the paper machine. In addition, a traversing measuring method is excessively slow for providing an effective and rapid control.

DE publication 29,923,284 discloses a paper machine in which a paper web is conveyed from a former, through a press section, to the beginning of a dryer section such that the paper web is always supported throughout by at least a roll or a band. A baby press comprising a suction roll and a press roll is arranged in connection with the end section of the former. A steam box is arranged between the former and the press section. A sensor, which measures a moisture profile of a paper web, is arranged at the beginning of the dryer section. The measurement can be used for controlling the steam box, the partial vacuum of the suction roll and the pressing force of the press roll. The presented solution is not able to adjust the moisture profile of the paper web effectively and rapidly enough in order to sufficiently eliminate defects in the properties of the finished paper resulting from the combined effect of differences in paper machine draw and moisture profile defects.

FI publication 104,988 discloses a solution, in which a surface temperature of first drying cylinders of a dryer section and dry matter/moisture content and temperature of a paper web are measured prior to first drying cylinders. The paper web moisture is controlled on the basis of these measurements. However, it would be useful to be able to control the paper web moisture profile more rapidly and effectively, so that defects in the finished paper resulting from the combined effect of the differences in paper machine draw and moisture profile defects could be eliminated efficiently enough.

Currently, one more typical approach is to overdry the paper by means of the dryer section of the paper machine so as to equalize the moisture profile of the paper. Overdrying deteriorates the quality of the paper, and furthermore, when the dryer section is used for overdrying the paper, the drying capacity of the dryer section is relatively limited.

U.S. Pat. Nos. 4,801,809 and 5,172,005 disclose solutions, in which paper web properties are measured at several points simultaneously utilizing CCD or other camera technology. DE publication 19,830,323 discloses measuring the thickness of a paper web such that a measuring beam is directed to the paper web with optical fibers and the beam from the web is directed to a measuring sensor with optical fibers. A plurality of optical fibers are thus arranged in parallel extending substantially across the whole paper web in the cross machine direction. Various solutions for measuring paper web properties have also been set forth in FI publication 73,319, DE publication 3,336,659, WO publication 98/40727 and U.S. Pat. No. 5,019,710. However, none of the above-mentioned publications discloses a solution for controlling a moisture profile of a paper web.

BRIEF SUMMARY OF THE INVENTION

The object of the present invention is to provide an improved solution for controlling the moisture profile of the paper web.

The method of the invention is characterized by disposing a measuring device adjacent the paper web, the measuring device comprising optical fibers through each of which radiation in the infrared range is transmitted to the paper web and optical fibers through each of which the radiation is transmitted from the paper web at a measuring point. The measuring device also includes a plurality of parallel measuring heads in which ends of the optical fibers are respectively arranged, the measuring heads being spaced apart in a cross-direction of the paper web. The method comprises steps of measuring the moisture profile of the paper web with the measuring device prior to drying the paper web, wherein the measuring heads are moved back and forth over part of the web width, perpendicularly to the travel direction of the paper web, such that the measuring heads substantially simultaneously measure web moisture at a plurality of measuring points distributed across substantially a full width of the paper web so as to measure a cross-direction profile of the web moisture across substantially the full width of the web; and controlling the moisture profile of the paper web based on the cross-direction profile measured before drying the paper web.

Further, an apparatus in accordance with the invention comprises a measuring device arranged in the paper machine before or at the beginning of the dryer unit to measure the moisture profile of the paper web by infrared measurement prior to drying the paper web, the measuring device being arranged to measure the cross direction profile of the web substantially simultaneously. The measuring device comprises optical fibers each of which is arranged to transmit infrared radiation to the paper web and optical fibers each of which is arranged to transmit the radiation from the paper web at a measuring point, measuring heads in which the ends of the optical fibers are respectively arranged, the measuring heads being spaced apart in a cross-direction of the paper web, and an oscillation means for making the measuring heads move back and forth over part of the web width, perpendicularly to the travel direction of the paper web, such that the measuring heads substantially simultaneously measure web moisture at a plurality of measuring points distributed across substantially a full width of the paper web so as to measure a cross-direction profile of the web moisture across substantially the full width of the web. The apparatus also includes a profiling device for controlling the moisture profile of the paper web on the basis of the moisture profile measured prior to drying the paper web.

The basic idea of the invention is that the moisture profile of the paper web is measured prior to drying and on the basis of said measurement alone the moisture profile of the paper web is controlled prior to drying. Further, it is essential that the measurement is performed with a measuring device which measures the cross direction profile of the web substantially simultaneously. The basic idea of one preferred embodiment is that the moisture profile is also measured after the drying and on the basis of said measurement the moisture profile of the paper web is controlled during the drying.

The invention has an advantage that the moisture profile can be equalized when the dry matter content is low before the paper web moves to a dryer section, and consequently, before the web will have its final structure, it is possible to eliminate defects resulting from the combined effect of a possible moisture profile defect and differences in draw in the drying section. Thus, paper web defects in tensile stiffness module and stretch at break can be eliminated, and a defect in the tensile profile can be prevented. Further, edge defects in the web, edge elongation and web flutter can be reduced. All in all, it is possible to reduce defects produced during the drying of paper, and this results in a more uniform quality of paper, better reelability and better runability also in further processing. By regulating the wet draw it is also possible to control paper properties, such as tensile stiffness module and stretch at break, in a desired direction. The moisture profile having been equalized already before the dryer section, there will be no need to overdry the paper in the dryer section in order to equalize the moisture profile. Hence, the solution increases drying capacity, because average moisture in the paper can be higher than previously. In addition, by measuring the paper moisture substantially simultaneously across the paper web, it is possible to obtain an accurate CD resolution of the measurements, which is of assistance in the web drying. The simultaneous profile measurement also makes the control faster, as compared with the traversing measurement that is currently in common use.

In the present document, the term 'paper' refers not only to paper, but also to paper board and tissue.

BRIEF DESCRIPTION OF THE SEVERAL VIEWS OF THE DRAWINGS

The invention will be described in greater detail in the attached drawings, wherein.

DETAILED DESCRIPTION OF THE INVENTION

Figure 1:
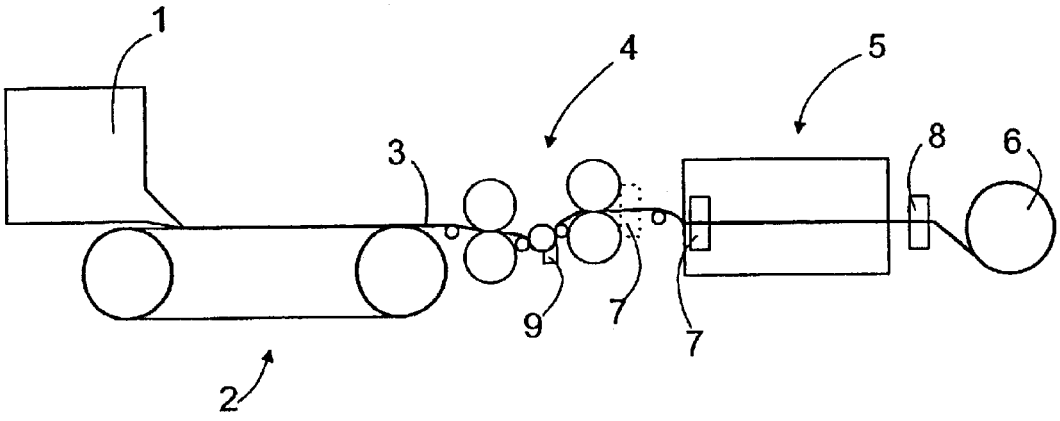
FIG. 1 is a schematic side view of a paper machine.

FIG. 1 shows schematically a paper machine. The paper machine comprises a headbox 1, from which stock is fed onto a former 2, where the stock is formed into a fiber web 3. The fiber web 3 is conveyed to a press unit 4 and further to a dryer unit 5. From the dryer unit 5 the web is conveyed to a reel 6. The paper machine may also comprise other parts, such as size presses and a calender, which are not illustrated in FIG. 1 for the sake of clarity. Furthermore, the function of the paper machine is known per se to the person skilled in the art, and will therefore not be further explained in this connection.

The paper machine further comprises a first measuring device 7, which is arranged to measure a cross direction profile of moisture in a moving paper web substantially simultaneously prior to paper web drying. The first measuring device 7 is arranged in the vicinity of the press unit 4, for instance at the beginning of the dryer unit 5 or immediately after the press, as indicated by broken lines in FIG. 1. The first measuring device 7 can also be placed in a location before the press section, between the former and the press section or immediately at the beginning of the press section before a first press roll nip, which locations are not shown in FIG. 1 for the sake of clarity. A second measuring device 8 is arranged after the dryer unit 5 for measuring the moisture profile after the drying. In connection with the press unit 4, there is further a steam box 9, by which the moisture profile of the paper web can be controlled.

Figure 2:
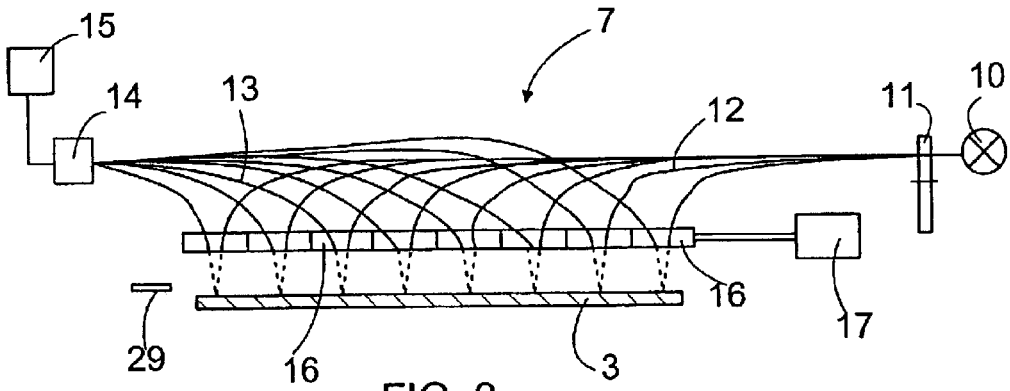
FIG. 2 is a schematic view of a measuring device for measuring paper web properties, seen in the travel direction of the paper web.

FIG. 2 shows schematically the structure and operating principle of the first measuring device 7. The first measuring device 7 comprises a radiation source 10, which emits radiation most preferably in the infrared range. The wavelength of the radiation can be e.g. within 1 to 2.5 $\mu$m, but when necessary, the wavelength can also be outside said range. The radiation source 10 can be a halogen lamp or a black body radiator or any other radiation source suitable for the purpose.

After the radiation source 10, there is arranged a chopper 11, which interrupts radiation emitted by the radiation source 10 in a manner known per se. The radiation is directed to the paper web with first optical fibers 12. The radiation reflected from the paper web 3 is forwarded with second optical fibers 13 to a spectrometer 14. The ends of both the first optical fibers 12 and the second optical fibers 13 are arranged in measuring heads 16. Necessary optical measuring accessories, such as lens or mirror arrangements or the like, can additionally be arranged in the measuring heads 16.

Figure 5:
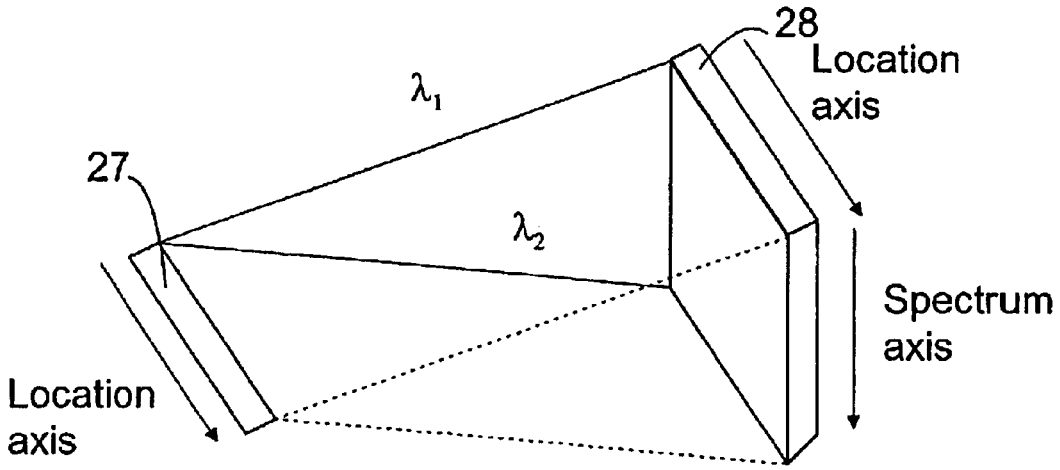
FIG. 5 is a schematic view of a spectrometer.

From the spectrometer 14 the measurement data is conveyed to a data processing or control unit 15. The spectrometer 14 is an imaging spectrometer, i.e. it images the spectrum of a measuring point. In this connection, the spectrometer refers to a measuring device, which comprises at least a spectrograph 27, preferably an imaging spectrograph, and a matrix detector 28. The spectrograph splits the radiation conveyed by the fiber into different wavelengths for the matrix detector 28. The imaging spectrograph 27 can be e.g. a PGP-type spectrograph or a grating spectrograph or any other spectrograph suitable for the purpose. Because measurement data are conveyed with second optical fibers 13 from a plurality of measuring points simultaneously, the apparatus determines the infrared spectrum reflected from the paper web 3 at a plurality of measuring points simultaneously. The apparatus thus provides a matrix, which describes the location and spectrum data of each measuring point. Most preferably the spectrum is measured in the near-infrared range, for instance within the range of 1.0 to 1.7 $\mu$m or 1.0 to 2.4 $\mu$m. Infrared light is thus split into a spectrum with the spectrograph 27, and the split light is measured with the matrix detector 28. FIG. 5 shows schematically the spectrograph 27 and the matrix detector 28. The spectrograph 27 receives data from each optical fiber at a particular point on a location axis. The data at each point is dispersed onto the matrix detector 28 at a particular point on the location axis such that the light is spread onto a spectrum axis. In FIG. 5, indications $\lambda_1$ and $\lambda_2$ illustrate the longest and shortest wavelength of the measuring zone.

Each measuring head 16 and optical fiber 13 constitute an individual measuring channel and it is possible to arrange as many parallel measuring channels as necessary. If channel resolution is e.g. 5 mm in the cross machine direction, and a 10-metre wide paper web 3 is to be covered substantially throughout, 2,000 measuring points, i.e. measuring channels, will be needed. However, the measuring heads 16 can be made to move back and forth part of the web 3 in CD by an oscillation means 17. By moving the measuring heads 16, for instance, for about 10 cm back and forth, the above-mentioned 10-meter wide paper web can be measured substantially throughout by utilizing 100 measuring channels. Such a short movement does not cause considerable mechanical stress to the fibers 12 and 13. Hence, it is possible to reduce the number of measuring channels considerably, and nevertheless, the measuring can be carried out in less than one second for the entire width of the paper web 1, as compared with the current situation, where traversing from one edge of the paper web to the other edge typically takes tens of seconds. By arranging the distance of the reciprocating movement to be slightly larger than the width of the channel, i.e. in the above case to be slightly larger than 10 cm, the adjacent measuring points also measure the same transversal position of the paper web 3, i.e. the measuring channels overlap. This measurement of the common point can be utilized, for instance, in making the measuring channels uniform, or even in transferring configuration.

The measuring apparatus also comprises a moving reference unit 29, which can be moved across the path of the measuring beams of all measuring channels. In that case, the same reference/calibration plate is used for calibrating all measuring channels. In the reflection measurement shown in FIG. 5, the calibration can be performed during the paper making process, i.e. the reference unit 29 is arranged to move between the measuring heads 16 and the paper web 3.

The measuring device 7 can be arranged in a relatively small space, because it will suffice that only the optical fibers 12 and 13 and the measuring heads 16 are arranged in a measuring bar required by the measuring device. The measuring arrangement of the measuring head 16 can also be implemented by mirror optics, whereby the arrangement will be particularly small in size. Other parts of the apparatus, such as the light source, the chopper, the spectrometer and the control unit, can be placed separately in a suitable location in the vicinity of the paper machine, with the proviso that the fibers retain their connection with said devices. The measurement can be performed either as reflection measurement as shown in FIG. 2 or the second optical fibers 13 can be arranged on the reverse side of the paper web 3, whereby the second optical fibers 13 convey the measuring beam, which has penetrated the paper web 3, to the spectrometer 14. The measurement can also be performed either when the web is against a wire, felt or roll, or in open draw. Instead of the imaging spectrometer 14, it is possible to employ e.g. an infrared line camera and to separate the wavelengths of the measuring points with interference filters placed in a rotating filter disc, for instance. With the measuring device 7 it is possible to measure, for instance, moisture, dry matter content, ash content or some other property of the paper web 3.

Figure 3:
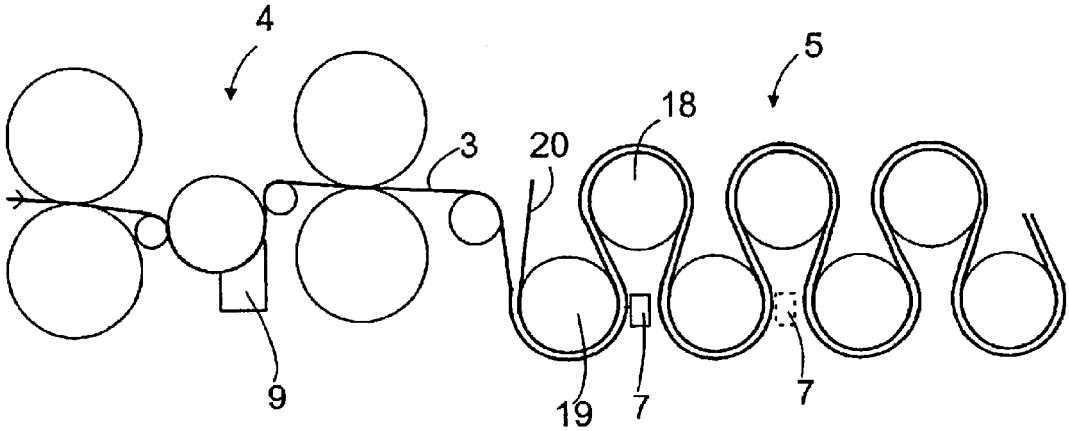
FIG. 3 is a schematic side view of a press section and beginning of a dryer section of the paper machine.

FIG. 3 shows how the measuring device 7 is placed at the beginning of a dryer unit 5. FIG. 3 shows some of the drying rolls, i.e. steam-heated cylinders 18 and vacuum cylinders 19, of the drying unit 5. The dryer unit 5 typically comprises several tens of steam-heated cylinders 18 and vacuum cylinders 19. FIG. 3 further shows a drying fabric 20. In principle, the measuring device 7 can be placed at any point in the dryer unit 5. However, if the paper web moisture is to be measured prior to drying, the measuring heads 16 of the measuring device 7 are most preferably arranged in connection with the first vacuum cylinder 19, as shown in FIG. 3. FIG. 3 also shows an alternative location, indicated by a broken line, for the measuring device 7 after the second vacuum cylinder 19. Even though the moisture measurement is not arranged immediately after the press 4, one or three drying rolls do not bring about any essential change in the moisture of the paper web 3, and therefore it can be defined that in both cases the paper web is measured for its moisture before it is dried. Inside the vacuum cylinders 19 there is vacuum, which makes the drying fabric 20 and the paper web 3 thereon adhere to the vacuum cylinder 19. The measurement is thus performed on top of the wire 20 and the roll 19, i.e. the paper web 3 is supported, and there is no need to arrange open draw for the measurement. The distance between the measuring heads 16 and the paper web 3 can be in the order of 10 cm.

Figure 4:
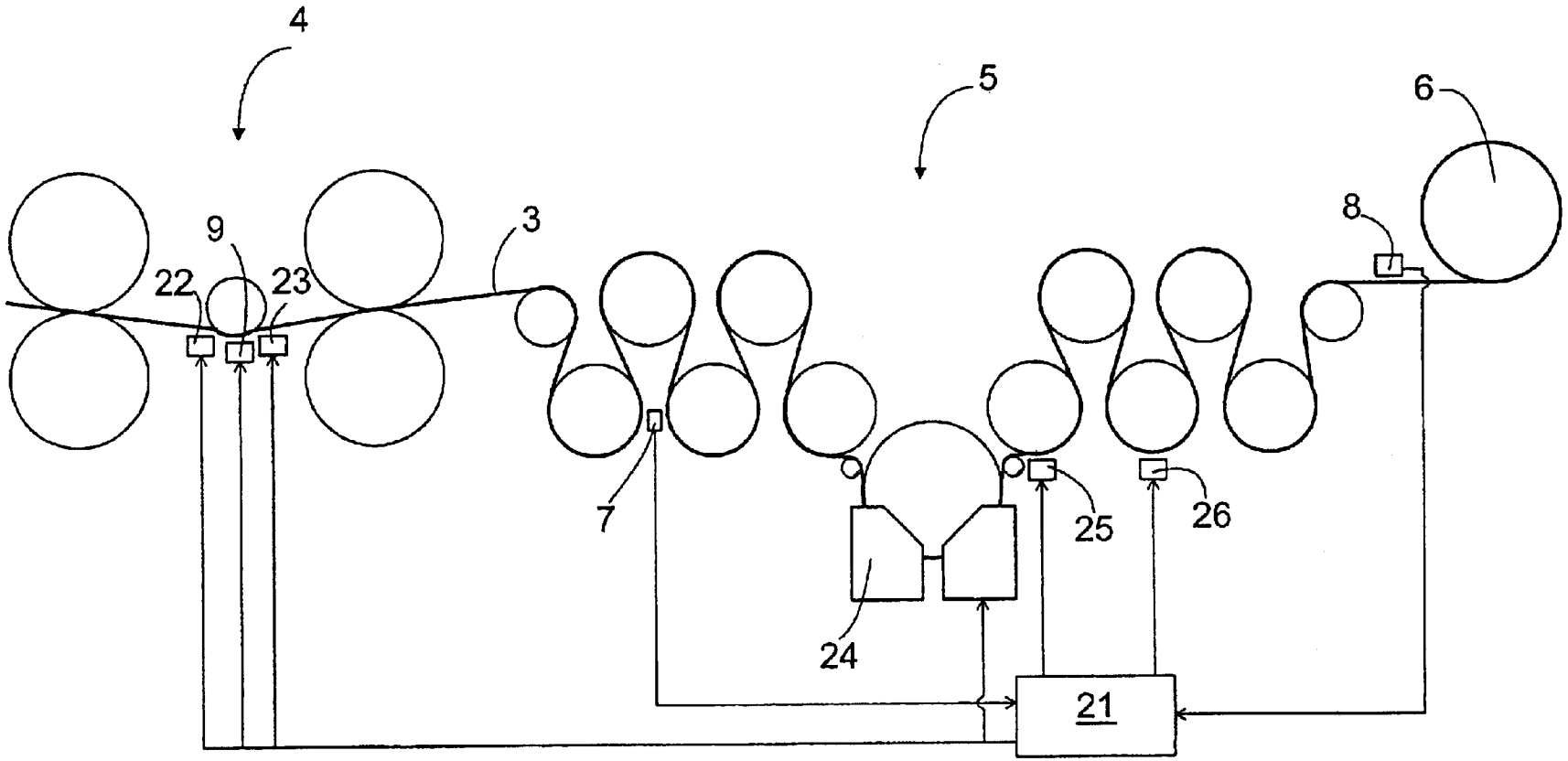
FIG. 4 is a schematic side view of the press section and the dryer section of the paper machine.

FIG. 4 shows the principle of moisture control concept. The system comprises a control unit 21, whereto CD moisture data on the paper web 3, prior to drying, is transmitted from the first measuring device 7. On the basis of said measurement the moisture profile of the paper web 3 is controlled before drying the web. Said moisture profile control can be carried out, for instance, by means of a steam box 9 arranged in connection with the press unit 4. For controlling the moisture profile, it is also possible to use an infrared heater 22 or a microwave dryer 23, for instance. Furthermore, it is possible to control the press section 4 itself. If the moisture profile measurement is carried out before the press section 4 or at the beginning of the press section 4, the moisture profile control is performed using feedforward control, for instance with a steam box 9 or other profile actuators of the press section 4.

The moisture profile control takes place such that the CD moisture profile of the paper web 3 having been obtained, the profile control device directs an operation to an excessively wet section of the paper web 3, for instance, which operation affects exactly said excessively wet section of the paper web 3. For instance, for the steam box 9 said control operation consists of increasing the amount of steam in said zone, whereby evaporation increases and the moisture profile can be rectified. The nip pressure of the press can also be controlled zone by zone, if the press comprises a roll enabling zone control. Also other above-mentioned profile control devices and, in addition, e.g. an impinged blowing unit in the dryer section can be controlled zone by zone.

Because the measurement is carried out with the first measuring device 7, which measures the cross direction profile of the whole paper web substantially simultaneously, and because the moisture profile of the paper web prior to drying is controlled by means of said measurement, it is possible to eliminate the defects in the finished paper resulting from the combined effect of drawing differences and moisture profile defects on the paper machine. Most preferably the moisture profile control takes place the dry matter content of the web being 40 to 70%. Because the measurement takes place rapidly and the profiling devices correcting the moisture profile of the paper web are most preferably arranged in the vicinity of the press unit 4, the moisture profile can be corrected without that a sudden disturbance in the moisture profile passes through the dryer unit 5 to the second measuring device 8. It is also possible to correct the moisture profile by means of the impinged blowing unit 24, in which case the impinged blowing unit 24 is most preferably arranged at the beginning of the dryer unit 5, when the paper web 3 is not yet completely dried. All in all, the control of the profiling device, i.e. the device correcting the moisture profile of the paper web 3, is not affected by control distorting factors, such as the dryer unit 5, and an equalized or smooth moisture profile can be achieved before the dryer unit 5. This also reduces, or even eliminates, a need to overdry the paper.

Most preferably the moisture profile is still corrected at a second stage by measuring the moisture profile of the paper web 3 with a second measuring device 8 after the dryer section 5. On the basis of the moisture measurement of the paper web 3 performed after the dryer section 5, the moisture profile of the paper web is controlled in the dryer unit 5. Adjustable variables of the dryer section, such as steam pressure of steam-heated cylinders of the dryer section or steam temperature or operation of vacuum cylinders, can then be adjusted, or the moisture profile control can employ a wetting box 25 or a steam box 26 arranged in the dryer unit 5. When the moisture profile of the paper web is also measured after the dryer unit 5, and the apparatus in the dryer section 5 for wetting or drying the paper web 3 is controlled on the basis of said measurement, it is possible to eliminate moisture profile defects and their effects appearing in the dryer section 5.

The drawings and specification are intended only to illustrate the inventive idea. The details of the invention may vary within the scope of the claims. So, if desired, the moisture profile measurement of the paper web can be carried out with a measuring device other than the one described herein. It is substantial that the whole cross direction profile of the web can be measured substantially simultaneously. The invention is particularly well suited for the control of the CD moisture profile of the paper web.

That which is claimed:

1. A method for controlling a moisture profile of a moving paper web during manufacture, the method comprising:

disposing a measuring device adjacent the paper web, the measuring device comprising optical fibers through each of which radiation in the infrared range is transmitted to the paper web and optical fibers through each of which the radiation is transmitted from the paper web at a measuring point, and a plurality of parallel measuring heads in which ends of the optical fibers are respectively arranged, the measuring heads being spaced apart in a cross-direction of the paper web;

measuring the moisture profile of the paper web with the measuring device prior to drying the paper web, wherein the measuring heads are moved back and forth, over part of the web width, perpendicularly to the travel direction of the paper web, such that the measuring heads substantially simultaneously measure web moisture at a plurality of measuring points distributed across substantially a full width of the paper web so as to measure a cross-direction profile of the web moisture across substantially the full width of the web; and controlling the moisture profile of the paper web, based on the measured cross-direction profile, before drying the paper web.

2. A method as claimed in claim 1, wherein the paper web is operated upon to control the moisture profile at a location where the dry matter content of the paper web is 40 to 70%.

3. A method as claimed in claim 1, wherein the paper web is treated with a press unit prior to drying, and the moisture profile measurement of the paper web prior to drying the paper web takes place after the press unit.

4. A method as claimed in claim 1, wherein the moisture profile of the paper web is controlled by adjusting a press unit.

5. A method as claimed in claim 1, wherein the moisture profile of the paper web is controlled by a steam box in connection with a press unit.

6. A method as claimed in claim 1, wherein by means of the moisture profile measurement of the paper web performed prior to drying the paper web, the moisture profile of the paper web prior to drying is controlled.

7. A method as claimed in claim 1, wherein the paper web is dried in a dryer unit, which comprises a plurality of drying rolls, and the moisture profile of the paper web is measured in connection with a first drying roll.

8. A method as claimed in claim 1, wherein the measurement of the moisture profile of the paper web prior to drying and the moisture profile control on the basis of said measurement are both arranged in connection with a press unit.

9. A method as claimed in claim 1, wherein the moisture profile of the paper web prior to drying is controlled by an impinged blowing unit, an infrared heater or a microwave dryer.

10. A method as claimed in claim 1, wherein the moisture profile of the paper web is also measured after drying, and the moisture profile of the paper web is controlled on the basis of said measurement in the dryer unit.

11. A method as claimed in claim 1, wherein when moisture is measured, a spectrum of the infrared range is measured by forming a matrix, which contains location data and spectrum data of each measuring point.

12. A method as claimed in claim 11, wherein the spectrum is measured with a spectrometer, which comprises a spectrograph and a matrix detector.

13. An apparatus for controlling the moisture profile of a paper web in a paper machine that comprises at least a headbox, a former, a press unit, a dryer unit, and a reel, the apparatus comprising:

a measuring device arranged in the paper machine before or at the beginning of the dryer unit to measure the moisture profile of the paper web by infrared measurement prior to drying the paper web, the measuring device being arranged to measure the cross direction profile of the web substantially simultaneously, the measuring device comprising optical fibers each of which is arranged to transmit infrared radiation to the paper web and optical fibers each of which is arranged to transmit the radiation from the paper web at a measuring point, measuring heads in which the ends of the optical fibers are respectively arranged, the measuring heads being spaced apart in a cross-direction of the paper web, and an oscillation means for making the measuring heads move back and forth over part of the web width, perpendicularly to the travel direction of the paper web, such that the measuring heads substantially simultaneously measure web moisture at a plurality of measuring points distributed across substantially a full width of the paper web so as to measure a cross-direction profile of the web moisture across substantially the full width of the web; and a profiling device for controlling the moisture profile of the paper web on the basis of the measured moisture profile prior to drying the paper web.

14. An apparatus as claimed in claim 13, wherein the measuring device for measuring the moisture profile of the paper web is arranged after the press unit.

15. An apparatus as claimed in claim 13, wherein the profiling device is a steam box, which is arranged in connection with the press unit.

16. An apparatus as claimed in claim 13, wherein the profiling device is arranged before the measuring device.

17. An apparatus as claimed in claim 13, wherein the measuring device for measuring the moisture profile of the paper web and the profiling device for controlling the moisture profile are both arranged in connection with the press unit.

18. An apparatus as claimed in claim 13, wherein the profiling device is an infrared heater or a microwave dryer in connection with the press unit, or an impinged blowing unit arranged at the beginning of the dryer unit.

19. An apparatus as claimed in claims 13, wherein the apparatus comprises a second measuring device, which is arranged to measure the moisture in the paper web after the dryer unit, and the apparatus further comprises means for controlling the moisture profile of the paper web on the basis of said measurement in the dryer unit.

20. An apparatus as claimed in claim 13, wherein the measuring device is arranged to measure a spectrum of the infrared range such that the measuring device is arranged to form a matrix, which contains location data and spectrum data of each measuring point.

21. An apparatus as claimed in claim 20, wherein the measuring device comprises a spectrometer for measuring the spectrum, which spectrometer comprises a spectrograph and a matrix detector.

* * * * *